United States Patent [19]

Saunders

[11] 3,995,826

[45] Dec. 7, 1976

[54] PELLET MOLD

[75] Inventor: Eugene Francis Saunders, Columbus, Nebr.

[73] Assignee: Saunders Archery Company, Columbus, Nebr.

[22] Filed: Apr. 21, 1975

[21] Appl. No.: 569,796

[52] U.S. Cl. ..... 249/161; 164/136; 425/318

[51] Int. Cl.[2] ..... B22D 23/08

[58] Field of Search ..... 164/136, 137, 341, 342; 249/139, 161, 162; 425/12, 318

[56] References Cited

UNITED STATES PATENTS

| | | | |
|---|---|---|---|
| 293,709 | 2/1884 | Brush | 164/136 |
| 406,165 | 7/1889 | Fox | 425/318 X |
| 604,436 | 5/1898 | Swartz | 425/318 |
| 1,584,757 | 5/1926 | Dow | 425/318 X |
| 1,852,254 | 4/1932 | Midlam | 425/318 X |
| 2,785,641 | 3/1957 | Wosse | 425/318 X |
| 3,309,741 | 3/1967 | LaPoint | 164/342 |
| 3,836,308 | 9/1974 | Upright | 425/318 |

*Primary Examiner*—Robert D. Baldwin
*Attorney, Agent, or Firm*—Kegan, Kegan & Berkman

[57] ABSTRACT

A molding apparatus for producing pellets from a fused material such as molten lead. The mold is characterized in that in use it is submersed in and then closed while in the molten mass. Thereafter, the closed mold is removed from the melt, cooled to set the casting, opened, and the pellet released. The apparatus obviates the pouring of hot molten metal into a gated cavity. Additional important features of the assembly include a novel camming lever which ensures complete and positive closure of the mold, and an annular arrangement of guide bars or ribs which extend tangentially from an outer edge of one of the mold elements to facilitate the alignment and positive seating and sealing of the mold halves when the mold is closed.

4 Claims, 6 Drawing Figures

PELLET MOLD

The present invention relates generally to a hand-manipulable clamp-like mold. More particularly, the invention is directed to an improved mold assembly useful to produce pellets of the type used with slingshots and similar devices.

An important feature of the mold assembly of the invention is that it obviates pouring hot molten lead or other material into a cavity mold.

Other features of the apparatus of the invention are its mechanical simplicity, its reliability, and its physical durability.

Another important feature of the apparatus is a novel camming lever or closure means whereby the pellet forming mold elements are brought into secure and fluid-sealing engagement while immersed in the molten material from which the pellet is to be formed.

Yet another feature of the invention is the inclusion of spring-like biasing means whereby the opposed, cooperating mold-carrying components of the assembly are held apart during submersion or insertion of the mold elements into the molten mass.

Still another important practical feature of the apparatus is the ease whereby the cooperating mold elements themselves may be replaced to refurbish the mold as may be required from time to time, or may be replaced by mold elements of a different size or shape.

A specific important feature of the mold elements themselves is the provision of escape passages for molten fluid whereby complete and unimpaired closure of the mold about a mold-defined finite quantity of fused material is ensured and the escape of excess material from the zone adjacent the mold cavity is enhanced.

An additional important mechanical feature of the mold elements is the inclusion of means whereby the alignment of the mold halves and the firm seating and sealing thereof is facilitated.

Other objects, advantages, and features of the invention will be apparent from the following description considered in conjunction with the accompanying drawings in which.

Figure 1:
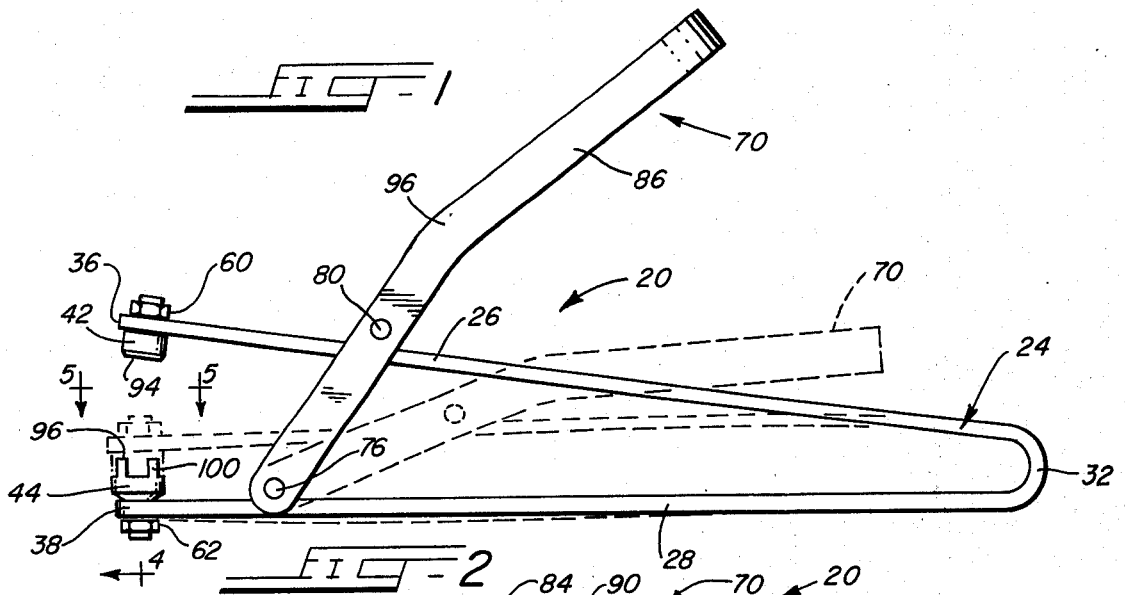
FIG. 1 is a side elevational view of the mold assembly of the invention, the broken lines showing the mold elements in the closed position.

In effectuating and achieving the aims and purposes of the present invention, there is provided a generally U-shaped frame to the opposed arms of which there are attached a pair of generally dish shaped mold elements aligned for face-to-face sealing engagement. The assembly includes a camming lever which is actuable to bring the opposed mold elements together while the latter are submerged in the molten mass or melt from which the molded pellet is to be produced.

Referring now to the drawings, and particularly to FIGS. 1,2,4 and 5, for the purposes of disclosure, the mold assembly 20 of the invention is shown as including a mold carrying frame 24 which, in the preferred embodiment of the invention illustrated, is generally U-shaped in form and consists of a pair of opposed arms or bars 26 and 28 formed of a single mechanical component which is bent 32 upon itself at a point intermediate its ends 36 and 38.

Conveniently, the integrally joined bars 26 and 28 are of steel or of an equivalent structural material having a degree of spring-like resiliency whereby the opposed free ends 36 and 38 of the assembly, normally apart, as shown in the solid lines of FIG. 1, may be forced toward one another, as required in the molding process. Bias forces will, thereafter, return the bars 26 and 28 to the open position. It will be appreciated that other mechanical arrangements are suitable as alternatives. For example, the arms or bars 26 and 28 may be hingedly joined rather than integrally connected. In the latter variation, a spring may be interposed between the two bars 26 and 28 as a means for biasing the bars apart. However, the mechanical arrangement shown in the drawing is preferred because of its extreme simplicity.

Figure 4:
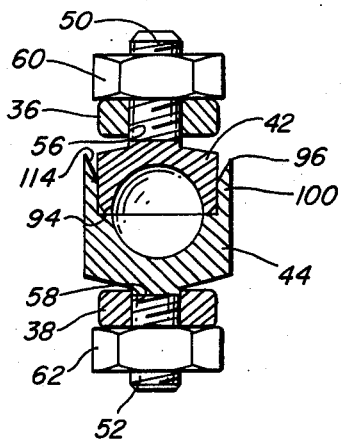
FIG. 4 is a cross sectional view taken substantially on the lines 4—4 of FIG. 2, but with the mold elements in the closed position.
Figure 5:
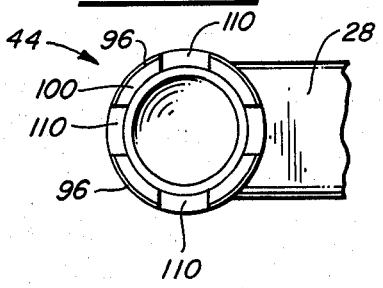
FIG. 5 is a top plan view taken substantially on the lines 5—5 of FIG. 1 and looking into the open lower element of the pellet forming mold.
Figure 6:
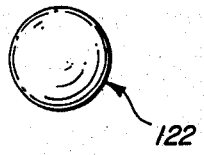
FIG. 6 represents the pellet as produced in the mold assembly illustrated.

A pair of mold elements 42 and 44 are attached to the opposed ends 36 and 38 of corresponding bars 26 and 28, at facing surfaces 46 and 48 thereof, with the open faces of the molds 42 and 44 presented toward one another, as shown in FIG. 4. In the specific form of the invention illustrated, the mold elements 42 and 44 are fastened to the bars 26 and 28 by means of stub bolts 50 and 52 extending through cooperating holes 56 and 58 near the bar ends 36 and 38, with nuts 60 and 62 threaded onto the bolts 50 and 52 and tightened against the respective bars 26 and 28. Alternatively, the mold elements 42 and 44 may be riveted, welded, brazed, or otherwise secured. The arrangement illustrated has the advantage in that the replacement or substitution of mold elements is facilitated for maintenance and for versatility.

Figure 2:
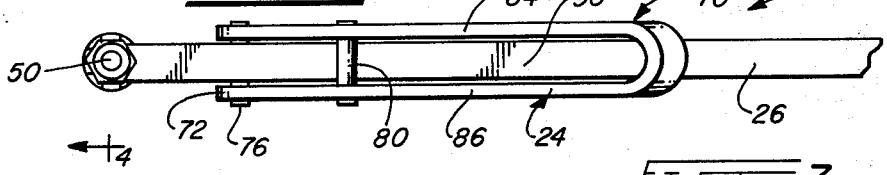
FIG. 2 is a top plan view of the apparatus of FIG. 1.
Figure 3:
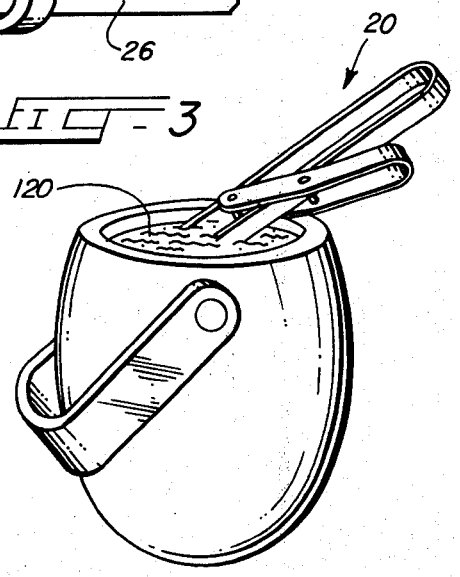
FIG. 3 is a perspective view showing the pellet forming elements immersed in a molten mass.

It will be appreciated that in carrying out the molding process it is necessary to bring the opposed mold elements 42 and 44 into fluid-tight sealing abutment. This may be accomplished by physically grasping or gripping the opposed arms 26 and 28 and forcibly urging them toward one another to overcome the biasing spring force which retains the bars in a normally separated position. An objectionable feature of this technique is that mold closure force must be maintained by the user through a substantial time period correlated with the filling of the mold and the required cooling thereof before a formed pellet can be released. In order to obviate such physical demands, as shown in FIGS. 1 and 2, there is provided a simple yet most effective mechanical assist means whereby the mold elements may be more easily and more readily brought together and may be held in a closed position with minimum energy demands. User fatigue is avoided.

As shown in FIG. 1, the mechanical mold closing assist consists of a lever 70 which, pivotally secured to one bar 28, acts upon the other 26 to bring the bars toward one another during mold closure. In the specific embodiment of the invention illustrated, the lever 70 is secured at one end 72 to the lower bar 28 of the assembly by means of a hinge or pivot pin 76 carried on the lower bar 28. At a position intermediate its ends and so located as to lie "above" the upper bar 26 of the assembly, the closing lever 70 carries a cam or boss 80, the latter engaging and bearing downwardly upon the upper arm 26 as the closing lever 70 is pivoted rearwardly about the pivot pin 76 so as forcibly to urge the two bars 26 and 28 and the bar-carried mold elements 42 and 44 toward one another. In order further to ensure in-line closure of the molds, the mold closing lever 70 is formed, between the pin means 76 and the cam 80, to define a pair of parallel, substantially coextensive spaced arms 84 and 86 defining a channel 90 for confining the upper bar 26 laterally and guiding its approach toward the lower bar 28 of the assembly during closure of the molds. The closure lever 70 is preferably bent somewhat 96 as a "dog-leg" for handling convenience. While the closure lever 70 may take any preferred mechanical form, in the specific embodiment of the invention illustrated, the lever constitutes a bar bent double upon itself.

The mold elements 42 and 44 are, as shown in FIG. 4, generally hemispherical or dish-shaped in form so that when brought to a closed position with abutting rimlike edges 94 and 96, the cavity formed internally of the mold is spherical. In the embodiment of the mold illustrated, one of the mold elements 44 is provided with an integrally formed railing consisting of a plurality of annularly spaced finger-like segments 100 defining a parapet-like wall disposed about and projecting substantially tangentially from the mold 44 outwardly from the rim-like edge 96 thereof.

The spaced segments 100 provide therebetween an array of corresponding spaced fluid passages 110 serving as fluid escape slots for the discharge or relief of molten fluid from the zone between the mold elements during closure of the mold.

The parapet-like wall formed by the spaced segments 100 serves additionally as a mold centering mechanism. As best seen in FIG. 4, the internal surface delineated by the railing is frustoconical annular guide wall 114 which tapers from a larger outer diameter to a somewhat reduced inner diameter. The enlarged outer diameter is slightly greater than the diameter of the edge 94 of the opposed mold element 42, whereas the inner diameter corresponds essentially to but is no less than the diameter of the edge 94 of the opposed mold 44, all as shown in FIG. 4. Accordingly, as the mold elements are brought to approach one another, the mold element 42 is guided along the internal wall 114 of the mold 44 to ensure positive functional alignment of the respective mold elements with one another and proper seating and sealing thereof during mold closure.

The operation of the mold assembly of the invention in use is simple. It is necessary merely to immerse the mold carrying ends 36 and 38 of the assembly in a molten bath 120 of a fused material such as a molten lead composition. The mold assembly is then closed to bring the mold elements 42 and 44 into sealing abutment and to capture therewithin a cavity-filling aliquot of the fused material. While holding the mold closed, the assembly is withdrawn from the molten bath and is allowed to cool so as to transform the fused, fluid contents of the mold into a solid article. Finally, the mold is opened and the formed solid pellet 122 released.

The foregoing description and the drawings are provided merely to explain and illustrate the invention and the manner in which it may be performed. The invention is not to be limited thereto except insofar as the appended claims are so limited, since those skilled in the art who have this disclosure before them will be able to make modification and variations therein without departing from the scope and the spirit of the invention.

I claim:

1. A mold assembly for fabricating solid ball-like pellets from a heat-fused mass of moldable material which is a solid at room temperature, said assembly comprising a pair of cooperating generally hemispherical mold elements including a first and a second dish-shaped open-face mold of a temperature-stable composition, a lower first bar means and an overlying second bar means, and means coupling said first and said second bar means pivotally relative to one another, pin means fastened to and carried by said lower bar means and extending transversely thereacross, mold closing lever means, said pin means pivotally securing said lever means adjacent an end thereof to said first bar means, fastener means securing one of said molds to each of said bar means with the open faces of the respective said mold elements presented toward one another in substantial alignment, a rim-like edge bounding each said dish-shaped mold at a peripheral margin thereof, spring means for biasing said bar means to urge free ends of said bar means apart and to sustain said mold elements carried thereby in a normally separated position, camming means carried by said lever means at a position intermediate the ends thereof for stressingly engaging said second bar means, said camming means being oriented so that upon shifting said lever means pivotally about said pin means said camming means engages and bears upon said second bar means forcibly to oppose and to overcome said spring means, thereby to urge said first and said second bar means and the bar means carried mold elements toward one another into engagement and to effect positive mold closure, said mold elements being so oriented, as secured to said bar means, that upon immersion of said mold elements in heat-fused material and closure of said mold assembly against the bias of said spring means the edges of said mold elements are brought into contiguous abutment to provide a substantially fluid-tight seal between said mold elements and to define a substantially fluid-tight cavity for retention of a cavity-filling aliquot of said material therewithin.

2. The mold assembly as set forth in claim 1 wherein said mold closing lever means includes, in a zone between said pin means and said camming means thereof, a pair of parallel, substantially coextensive spaced arms, said arms bracketing said second bar means to define a channel for guiding said second bar means in its approach toward said first bar means during closure of said mold.

3. The mold assembly as set forth in claim 1 and further comprising a railing integrally formed with one of said mold elements, said railing constituting a plurality of spaced segments defining a parapet-like wall annularly disposed about and projecting substantially tangentially from said dish-shaped mold at said edge thereof, said spaced segments defining therebetween a corresponding circumambient array of spaced fluid passages serving as escape slots for discharge of excess molten fluid from a zone between said mold elements during closure of said mold.

4. The mold assembly as set forth in claim 1 and further comprising a railing integrally formed with one of said mold elements, said railing defining a mold-centering frustoconical annular guide wall, said guide wall tapering from a larger outer diameter to a somewhat reduced inner diameter, said outer diameter being slightly greater than the diamter of the rim-like edge of the other of said mold elements and the inner diameter corresponding essentially to but being no less than the diameter of the rim-like edge of the other of said mold elements, thereby to ensure positive functional alignment of said mold elements with one another and proper seating and sealing thereof during mold closure.

* * * * *